US005793331A

United States Patent [19]

Anzai et al.

[11] Patent Number: 5,793,331

[45] Date of Patent: Aug. 11, 1998

[54] USER REPLACEABLE FLEXIBLE RETRACTABLE ANTENNA

[75] Inventors: Masahito Anzai, Taipei, Taiwan; Dennis Chua, Singapore, Singapore; King Hoe Goh, Singapore, Singapore; Ai Choo Loh, Singapore, Singapore

[73] Assignee: Lucent Technologies Inc., Murray Hill, N.J.

[21] Appl. No.: 693,839

[22] Filed: Aug. 1, 1996

Related U.S. Application Data

[60] Provisional application No. 60/003,647 Aug. 31, 1995.

[51] Int. Cl.[6] ..... H01Q 1/24

[52] U.S. Cl. ..... 343/702; 343/901; 343/903

[58] Field of Search ..... 343/702, 903, 343/900, 901, 895, 715; H01Q 1/24

[56] References Cited

U.S. PATENT DOCUMENTS

| | | | |
|---|---|---|---|
| 2,214,685 | 6/1940 | Stone, Jr. | 343/901 |
| 3,675,616 | 7/1972 | McInnis | 343/901 |
| 5,243,355 | 9/1993 | Emmert et al. | 343/702 |
| 5,258,772 | 11/1993 | Inanaga et al. | 343/702 |
| 5,387,048 | 2/1995 | Kuo | 403/109 |
| 5,526,005 | 6/1996 | Koo | 343/901 |
| 5,594,459 | 1/1997 | Hirota | 343/901 |

FOREIGN PATENT DOCUMENTS

| | | | |
|---|---|---|---|
| 0868768 | 1/1942 | France | 343/901 |

*Primary Examiner*—Michael C. Wimer
*Assistant Examiner*—Tan Ho

[57] ABSTRACT

A user replaceable flexible retractable antenna for use with a cordless phone comprises a conductive base pipe assembly having a screw terminal to be threadably received on a bracket assembly of the cordless phone, and a flexible antenna assembly having a conductive contact secured to one end slidably received within the base pipe assembly. The contact is maintained in sliding communication with the inner wall of the base pipe assembly and is connected to a conductive helix extending through the flexible antenna to define a conductive path between the distal end of the flexible antenna and the screw terminal of the base pipe assembly. The antenna can be easily removed from the cordless phone by rotating the base pipe assembly to disengage the screw terminal from the bracket assembly.

6 Claims, 1 Drawing Sheet

USER REPLACEABLE FLEXIBLE RETRACTABLE ANTENNA

CROSS REFERENCE TO RELATED APPLICATIONS

This application claims the benefit of the prior filed U.S. provisional application Ser. No. 60/003,647, filed Aug. 31, 1995.

BACKGROUND OF THE INVENTION

1. Field of the Invention

The present invention relates to a retractable flexible antenna and more particularly to a retractable flexible antenna for use with a cordless phone that can be easily replaced by a user.

2. Description of Related Art

A retractable flexible antenna is disclosed by Inanaga et al. in U.S. Pat. No. 5,258,772. The antenna comprises a tubular case fixedly secured within the housing of a cordless phone, a retractable flexible antenna slidably received in the tubular case, and a conductive coil spring connected at one end to the tubular case and at the other end to the base of the flexible antenna. The coil spring forms part of the conductive path through the antenna. One problem associated with Inanaga et al.'s antenna is that the coil spring has a tendency to become detached from either the tubular case or the flexible antenna rendering the phone inoperable. In order to have the antenna repaired, the phone has to be brought to a service center and taken apart to reattach the coil spring. The present invention eliminates this problem.

SUMMARY OF THE INVENTION

The present invention is designed to overcome the above mentioned problem by eliminating the coil spring and providing an antenna housing that can be easily removed from a cordless phone and replaced by a user. In doing so, the present invention employs a conductive base pipe assembly having a screw terminal at its lower end to be threadably received on a bracket assembly of a cordless phone. A flexible antenna assembly is slidably received within the base pipe assembly and has a first end moveable between extended and retracted positions and a second end having a conductive contact member attached thereto. The conductive contact member is connected to a helix that extends within and along the entire length of the flexible antenna assembly. An outer surface of the contact also engages the inner surface of the base pipe assembly such that a conductive path is defined between the distal end of the helix within the flexible antenna and the screw terminal secured to the lower end of the base pipe assembly.

The antenna of the present invention is more durable than Inanaga's retractable flexible antenna and will never have to be brought to a service center for repair. If the antenna ever does become damaged, a user can simply unscrew the antenna by rotating the base pipe assembly to disengage the screw terminal from the cordless phone. The antenna can than be easily replaced by screwing a new antenna into engagement with the cordless phone.

DETAILED DESCRIPTION OF THE PREFERRED EMBODIMENTS

Figure 1:
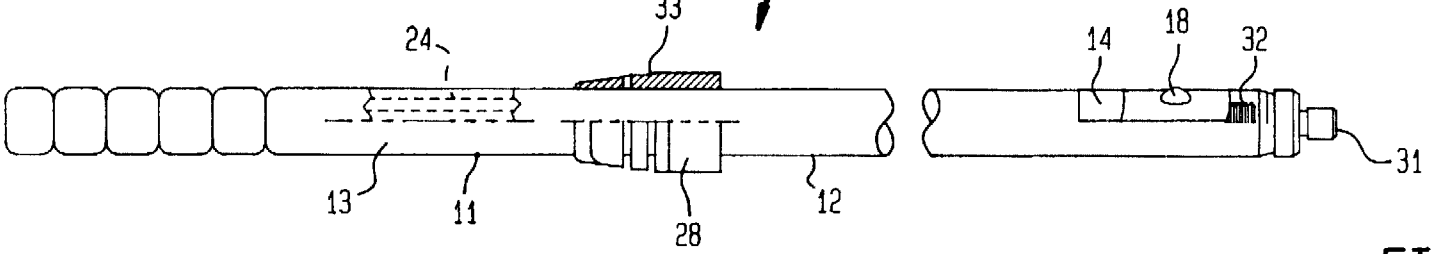
FIG. 1 is a side view in partial cross-sectional view of the antenna of the present invention.
Figure 2:
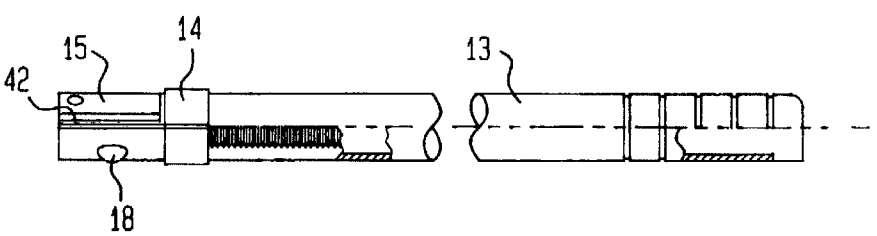
FIG. 2 is a side view in partial cross-sectional view of the antenna assembly.
Figure 4:
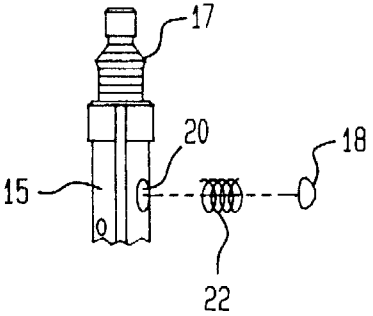
FIG. 4 is an exploded view of the contact member.

One embodiment of the present invention will now be described in detail with reference to FIGS. 1 to 4. Referring now to FIG. 1, there is shown the antenna 10 embodying the invention. The antenna 10 comprises an antenna assembly 11 having a proximal end slidably received within a base pipe assembly 12 and a distal end moveable between extended and retracted positions.

The antenna assembly 11 includes a hollow flexible tube 13 constructed preferably of TFE tubing, having an open proximal end and a closed distal end. An electrically conductive helix 24 extends within the flexible tube 13 from the open end to the closed distal end. A conductive contact 14, preferably formed of copper, has a first section 15 having a diameter slightly smaller than the inner diameter of the base pipe assembly 12, and a second reduced diameter section 17 having grooves formed thereabout. The second grooved section 17 is secured in the open end of the flexible tube 13 by engagement of the grooves with the inner wall of the flexible tube 13. One end of the helix 24 engages the second grooved section 17 to provide a conductive path thereacross. The first section 15 of the contact is in sliding engagement with the inner wall of the basepipe assembly 12. At least one ball bearing 18 is positioned in at least one bore 20 formed in the contact 14 and is biased toward the open end of the bore by a compressed spring 22 extending between the bottom of the bore and the ball bearing 18. The ball bearing 18 and spring 22 ensure continuous communication between the contact 14, via the ball bearing 18, and the base pipe assembly 12. The ball and spring assembly will be discussed in more detail hereinbelow.

Figure 3:
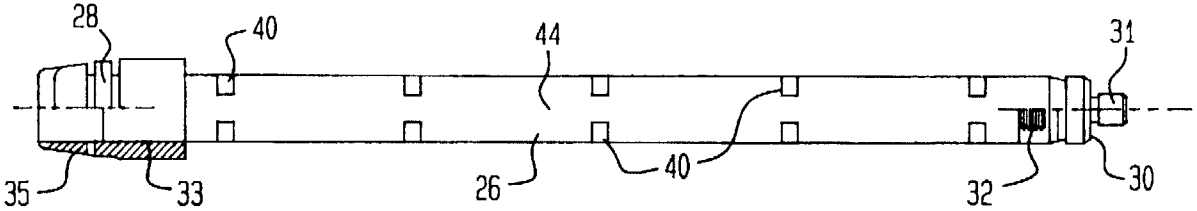
FIG. 3 is a side view in partial cross-sectional view of the base pipe assembly.

As illustrated in FIG. 3, the base pipe assembly 12 comprises an elongated pipe 26 having open ends, a shoulder grip 28 secured about the exterior of one end of the pipe 26, and a screw terminal 30 secured in the other end of the pipe. The screw terminal 30 is preferably press fit in the pipe 26 and has an outwardly extended threaded portion 31 extending therefrom. The end face of the screw terminal 30 located within the pipe 26 has cushioning device 32 attached thereto to prevent the contact 14 from striking the screw terminal 30 when the antenna assembly 11 is fully retracted. The end of the elongated pipe 26 having the shoulder grip 28 secured thereto further includes an annular metal rim 33 secured between the pipe 26 and the shoulder grip 28. The metal rim 33 is formed with longitudinal ridges onto which the shoulder grip 28 is secured. An inwardly extending annular flange 35 projects from the metal rim 33 to form an upper stop surface for the contact 14 to prevent disengagement of the antenna assembly 11 from the base pipe assembly 12. The inner wall of the elongated pipe 26 includes at least one guide channel 44 extending longitudinally along the entire length of the pipe. Each guide channel 44 is configured to receive a tab 42 formed on the contact 14 to prevent relative rotational movement between the base pipe assembly 12 and the antenna assembly 11.

As best illustrated in FIG. 3, the elongated pipe 26 is formed with at least one series of aligned openings 40 spaced longitudinally along its length. The openings 40 are configured to partially receive the spring biased ball bearing 18 positioned within the blind bore 20 of the contact 14. The guide channel 44 and the tab 42 maintain alignment between the ball bearing 18 and the openings 40 to assure engagement therebetween. Each opening 40 defines a different position of the antenna 10 from fully retracted to fully extended. When the ball bearing 18 engages an opening 40, locking the antenna assembly 11 in position with respect to the base pipe assembly 12, a clicking sound is produced to indicate that the antenna 10 is locked in position. It has been discovered that a more audible sound is produced if the openings 40 are rectangular. Preferably, the antenna 10 includes only a single spring biased ball bearing 18 aligned with a single row of openings 40. However, a plurality of each could be provided to increase the degree of engagement between the base pipe assembly 12 and the antenna assembly 11 or to increase the contact area between the contact 14 and the inner wall of the elongated pipe 26.

While the invention has been particularly shown and described with reference to preferred embodiments thereof, it will be understood by those skilled in the art that various changes in form, details, and application may be made therein without departing from the spirit and scope of the invention. Accordingly, it is intended that all such modifications and changes be included within the scope of the appended claims.

What is claimed is:

1. An antenna for use with a cordless telephone comprising:

an elongated base pipe constructed from an electrically conductive material having at least one series of longitudinally aligned openings;

a flexible antenna sleeve having a first end slidably positioned within said elongated base pipe and a second end extending therefrom, said antenna sleeve being moveable between retracted and extended positions;

an electrically conductive element extending through the flexible antenna sleeve;

an electrically conductive contact connected to the first end of the flexible antenna sleeve, the contact being in sliding contact with an inner wall of the base pipe and being in contact with one end of the conductive element, said contact having at least one bore with a spring and a ball positioned therein, said spring biasing said ball into engagement with one of said longitudinally aligned openings to selectively retain said antenna in any one of a plurality of intermediate positions from extended to retracted;

an electrically conductive connector connected to one end of the base pipe, the connector having a threaded extension for securing the antenna assembly to the cordless telephone; and wherein the conductive element, the contact, the base pipe, and the connector form a continuous electrically conductive path between the second end of the flexible antenna and the threaded extension.

2. The antenna of claim 1 wherein said openings are rectangular.

3. The antenna of claim 1 wherein said spring and said ball are formed from electrically conductive material to ensure continuous contact between said contact and said base pipe.

4. The antenna of claim 3 wherein said at least one bore comprises two bores and said at least one series of openings comprises two series of openings, and wherein each of said bores have a spring and a ball positioned therein and aligned with one of said series of openings to selectively retain said antenna in any one of a plurality of positions from extended to retracted.

5. The antenna of claim 4 further including at least one guide channel formed in said base pipe configured to receive a respective guide tab formed on said connector, said guide channel and guide tab maintaining alignment between said spring biased balls and said series of openings.

6. The antenna of claim 1 further including at least one guide channel formed in said base pipe configured to receive a guide tab formed on said connector, said guide channel and guide tab maintaining alignment between said spring biased ball and said series of openings.

* * * * *